US011358833B2

(12) United States Patent
Li et al.

(10) Patent No.: US 11,358,833 B2
(45) Date of Patent: Jun. 14, 2022

(54) GUIDE DEVICE AND ELEVATOR SYSTEM

(71) Applicant: Otis Elevator Company, Farmington, CT (US)

(72) Inventors: Qing Li, Tianjin (CN); Kai Kang, Tianjin (CN); ShengYu Wang, Tianjin (CN); Bai Hebin, Tianjin (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 128 days.

(21) Appl. No.: 16/829,194

(22) Filed: Mar. 25, 2020

(65) Prior Publication Data

US 2021/0053796 A1 Feb. 25, 2021

(30) Foreign Application Priority Data

Aug. 22, 2019 (CN) ..... 201910779337.X

(51) Int. Cl.

| | |
|---|---|
| ***B66B 7/02*** | (2006.01) |
| ***B66B 7/06*** | (2006.01) |
| ***B66B 9/00*** | (2006.01) |

(52) U.S. Cl.

CPC ..... *B66B 7/02* (2013.01); *B66B 7/068* (2013.01); *B66B 9/00* (2013.01)

(58) Field of Classification Search

CPC ..... B66B 7/068; B66B 7/02; B66B 9/00
See application file for complete search history.

(56) References Cited

U.S. PATENT DOCUMENTS 4,230,205 A * 10/1980 Darwent ..... B66B 7/068 187/265

FOREIGN PATENT DOCUMENTS

| | | | | |
|---|---|---|---|---|
| CN | 107089572 A * | 8/2017 | | |
| JP | 2001247276 A | 9/2001 | | |
| JP | 6092356 B1 | 3/2017 | | |
| WO | WO-2015033423 A1 * | 3/2015 | ..... | B66B 7/068 |

OTHER PUBLICATIONS

Machine translation of JP 6092356.*
European Search Report for Application No. 20164998.5; dated Sep. 18, 2020; 5 Pages.

* cited by examiner

*Primary Examiner* — Diem M Tran
(74) *Attorney, Agent, or Firm* — Cantor Colburn LLP

(57) ABSTRACT

A guide device and an elevator system are provided by the present application. The guide device is configured to guide a compensation chain of an elevator system and includes: a fixed mechanism, which is configured to install to an elevator hoistway, for example a stationary object such as a hoistway wall, a rail or a pit ground, and provide support for the guide device; and a guide mechanism connected to the fixed mechanism; wherein in a state where the guide mechanism is subjected to an external force exceeding a preset value, the guide mechanism is capable of reciprocating in a vertical direction relative to the fixed mechanism.

10 Claims, 7 Drawing Sheets

GUIDE DEVICE AND ELEVATOR SYSTEM

FOREIGN PRIORITY

This application claims priority to Chinese Patent Application No. 201910779337.X, filed Aug. 22, 2019, and all the benefits accruing therefrom under 35 U.S.C. § 119, the contents of which in its entirety are herein incorporated by reference.

FIELD OF THE INVENTION

The present application relates to the field of elevators, and in particular to a guide device for a compensation chain of an elevator system.

BACKGROUND OF THE INVENTION

As a tool to improve passengers' walking between floors or shorten a walking distance of passengers, passenger transport devices are very common in our daily life. As an example, escalators and elevators typically used between floors of a building and automatic walkways typically used in large airports are particularly common.

For elevator systems, it is often necessary to provide a dedicated hoistway for installation of various components, including: a car operating in the hoistway, a counterweight that realizes force-balance with the car, and a compensation chain that connects the car and the counterweight and makes a compensation as required. Since the hoistway space is relatively small, there is a high requirement on the compactness of the structure of the elevator system. In this case, if the compensation chain sways during the movement of the car, it may entangle, involve, or snap with surrounding parts, further causing operational problems or safety hazards.

Therefore, a compensation chain guide device is usually provided for the compensation chain in the hoistway, which can relatively effectively restrain the sway range of the compensation chain. Existing compensation chain guide devices are generally desired to be placed below the end of a stroke of a buffer. In this case, when the elevator runs abnormally and causes the counterweight to fall, the buffer may be used to buffer the counterweight firstly to prevent the counterweight from impacting the compensation chain guide device and damaging it. At the same time, however, an installation position of the compensation chain guide device is also constrained by the position of the compensation chain. It is generally expected to install the compensation chain guide device at the tangent point or a position above the tangent point of the compensation chain, and the tangent point will change with the relative movement of the counterweight. In addition, the actual installation process is also constrained by various surrounding structures and the size of the internal space of the hoistway. Under the above overall requirements, if the installation position is too low, it is easy to cause the compensation chain guide device to be lower than the tangent point of the compensation chain, thereby causing the compensation chain to collide with surrounding parts and entangle with them, and even pull the parts apart. If the installation position is too high, it is easy for the compensation chain guide device to be hit and broken by the counterweight that is going down in an abnormal state.

Therefore, how to design a suitable compensation chain guide device has become a technical problem that needs to be solved in the field.

SUMMARY OF THE INVENTION

The present application aims to provide a guide device and an elevator system for meeting a proper guiding effect of the elevator system on a compensation chain under various conventional and non-conventional operating states.

In order to achieve at least one object of the present application, according to an aspect of the present application, a guide device is provided, which is configured to guide a compensation chain of an elevator system and includes: a fixed mechanism, which is configured to install to an elevator hoistway and provide support for the guide device; and a guide mechanism connected to the fixed mechanism; wherein in a state where the guide mechanism is subjected to an external force exceeding a preset value, the guide mechanism is capable of reciprocating in a vertical direction relative to the fixed mechanism.

Optionally, the fixed mechanism includes: a limiting portion which limits a direction of the movement of the guide mechanism relative to the fixed mechanism to a vertical direction; and a resistance buffering portion which provides a resistance in the direction of the movement of the guide mechanism relative to the fixed mechanism, wherein in a case that an external force exerted to the guide mechanism exceeds the resistance, the guide mechanism moves relative to the fixed mechanism.

Optionally, the limiting portion is a limiting slot, a slot width of the limiting slot at an opening being smaller than a slot width of an inner portion of the slot; and the guide mechanism has a first end extending into the limiting slot and having a contour matching with the limiting slot.

Optionally, the resistance buffering portion is a plurality of locking grooves disposed inside the limiting slot in a vertical direction; and the first end of the guide mechanism has an installation hole in which an elastic member and at least one ball are disposed, wherein in a state where no external force is exerted to the elastic member, the elastic member presses the at least one ball to protrude from the installation hole and embed into at least one of the plurality of locking grooves.

Optionally, the resistance buffering portion provides continuous resistance adjustment or multi-stage resistance adjustment for the guide mechanism.

Optionally, the resistance buffering portion is one of a ratchet wheel or ratchet teeth, and the guide mechanism includes the other of the ratchet teeth or ratchet wheel.

Optionally, the guide mechanism includes a guide frame, wherein in an installed state, the compensation chain of the elevator system is arranged to pass through the guide frame, and a swaying space of the compensation chain is restricted by the guide frame.

Optionally, the guide frame has a built-in buffering and limiting frame, wherein in a case of colliding with the swaying compensation chain, the buffering and limiting frame is capable of swaying inside the guide frame to provide buffering and limiting for the compensation chain.

In order to achieve at least one object of the present application, according to another aspect of the present application, an elevator system is further provided, which includes: a car, a counterweight, a buffer, a compensation chain, and the guide device as described above; wherein two ends of the compensation chain are connected to the car and the counterweight respectively, and the compensation chain is arranged to pass through the guide mechanism of the guide device; and wherein the fixed mechanism of the guide device is installed at a lower part of the elevator hoistway, and the buffer is connected to the guide device below the guide device.

Optionally, a start point of the movement of the guide mechanism of the guide device corresponds to the tangent point of the compensation chain in the installed state or a position above the tangent point.

Optionally, a start point of the movement of the guide mechanism of the guide device corresponds to a highest plane of the buffer in an uncompressed state.

Optionally, a movement distance of the guide mechanism of the guide device is greater than or equal to a compression stroke of the buffer.

According to the guide device and the elevator system of the present application, by providing the fixed mechanism and the guide mechanism capable of moving relative to each other, the demand of guiding the compensation chain in the normal state can be satisfied, and also in a case of sudden abnormal condition, through a downward movement resulting from both the impact of the counterweight and the buffering provided by the buffer, the guidance to the compensation chain is continued and damage is avoided.

DETAILED DESCRIPTION OF THE EMBODIMENT(S) OF THE INVENTION

Figure 1:
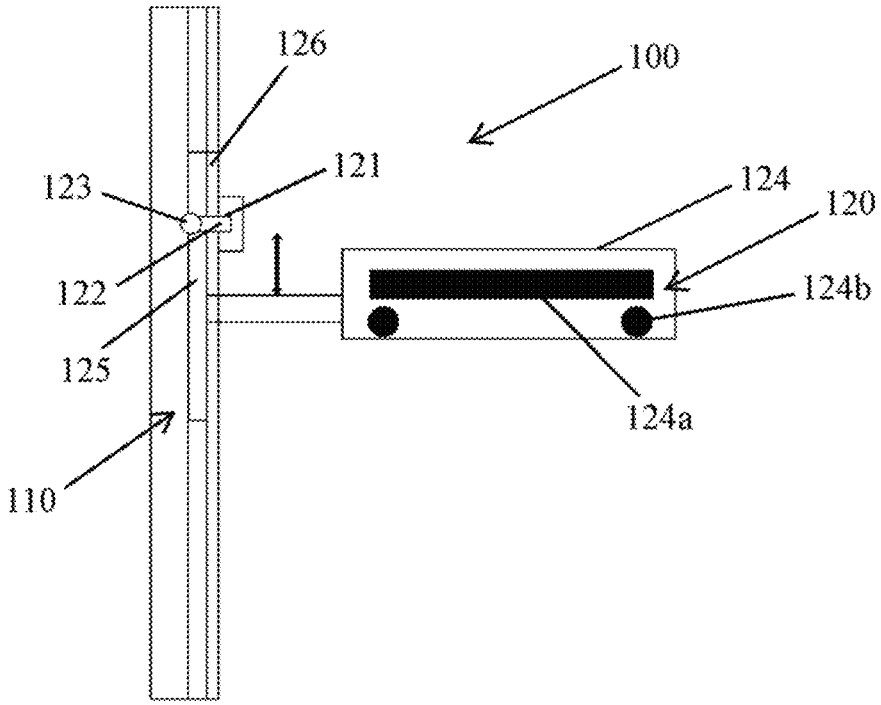
FIG. 1 is a view of an embodiment of a guide device at a first perspective.
Figure 2:
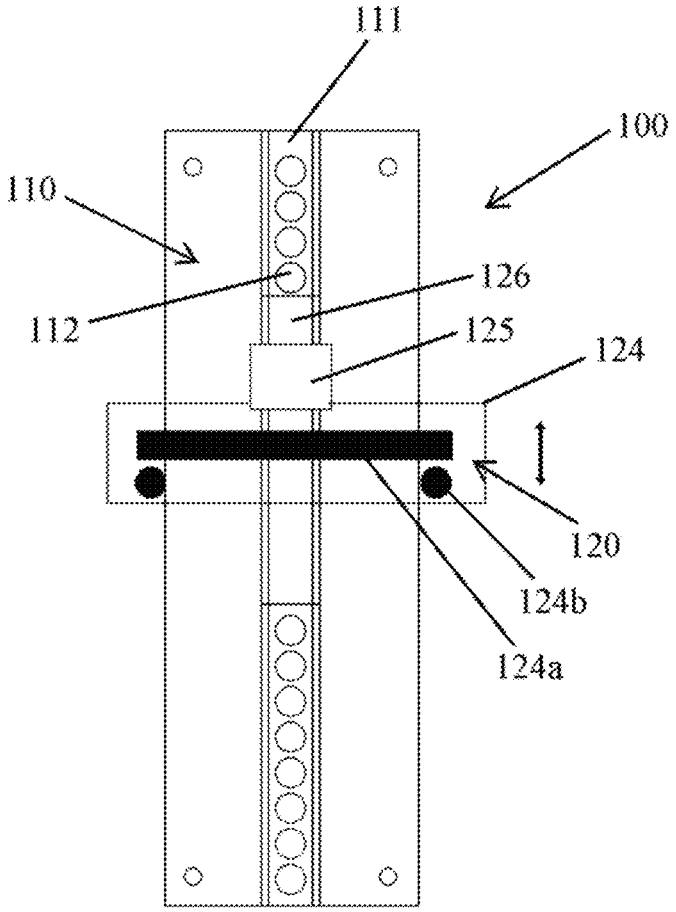
FIG. 2 is a view of an embodiment of a guide device at a second perspective.

An embodiment of a guide device for guiding a compensation chain of an elevator system of the present application is described herein with reference to FIGS. 1 to 4. Referring to the drawings, the guide device 100 includes a fixed mechanism 110 and a guide mechanism 120. The fixed mechanism 110 may be installed to a stationary object such as an inner wall of an elevator hoistway, a rail or a pit ground via bolts or fastening means, thereby providing a fixed support for the guide device 100. The guide mechanism 120 is movably connected to the fixed mechanism 110 and is conditionally movable relative to the fixed mechanism 110. Specifically, the guide mechanism 120 is capable of reciprocating relative to the fixed mechanism 110 in a vertical direction in a state where the guide mechanism 120 is subjected to an external force exceeding a preset value. Under such an arrangement, not only the guide device 100 can meet the demand of guiding a compensation chain 240 in a normal state of the elevator system, but also in a case of sudden abnormal condition, with the design of the fixed mechanism 110 and the guide mechanism 120 capable of moving relative to each other, through a downward movement of the guide mechanism 120 at the same time a counterweight 220 impacts a buffer, the guidance to the compensation chain 240 is continued, and damage of the compensation chain 240 itself or entanglement of the compensation chain 240 with other parts and pulling other parts apart are avoided.

It should be understood that the preset value mentioned above may be set or adjusted according to the actual situation of elevator installation. Generally, in a state of normal operation of the elevator system, the guide device is not subjected to an external force; whereas in an abnormal state, it may be subjected to a pressure applied by the counterweight from top to bottom. In order to avoid pressure-induced damage of the guide device, the corresponding preset value may be set according to a pressure bearing capability of the applied guide device, and when a resultant force of the external forces is greater than the preset value, the guide device is moved downward to avoid potential possibility of destroy.

In order to realize the functions of the fixed mechanism 110 and the guide mechanism 120 in the aforementioned guide device, various mechanical structures may be employed. An exemplary description will be given below with reference to FIGS. 1 to 4.

Figure 3:
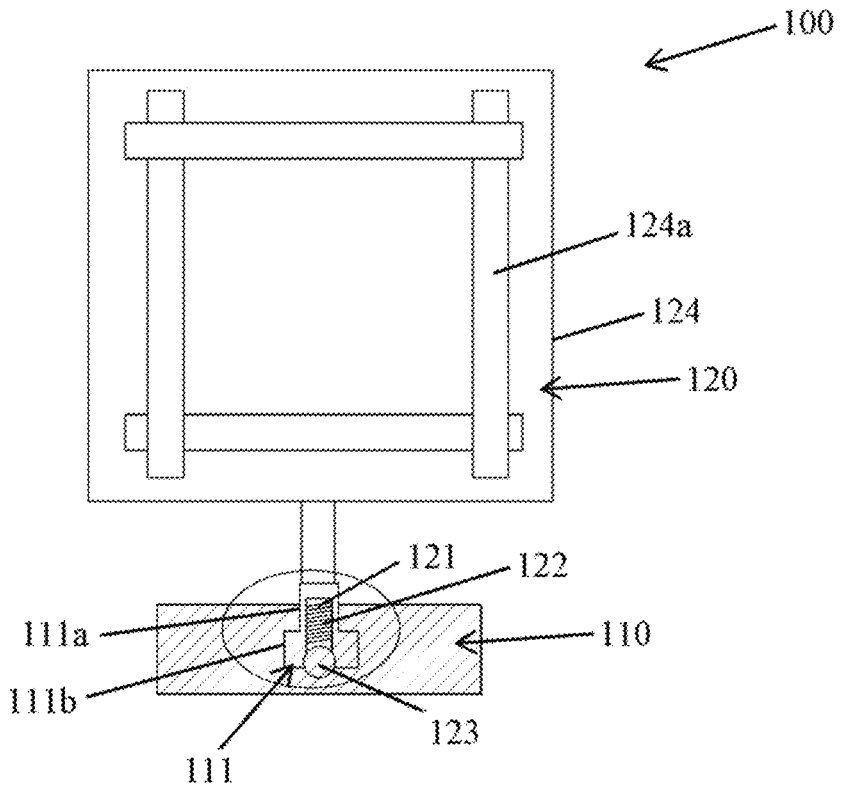
FIG. 3 is a view of an embodiment of a guide device at a third perspective.
Figure 4:
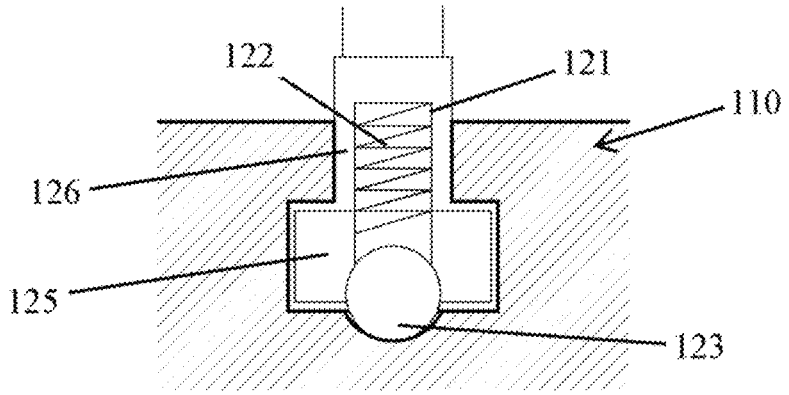
FIG. 4 is a partially enlarged view of an embodiment of the guide device in the figures, showing details of a connection between the guide mechanism and the fixed mechanism.
Figure 5:
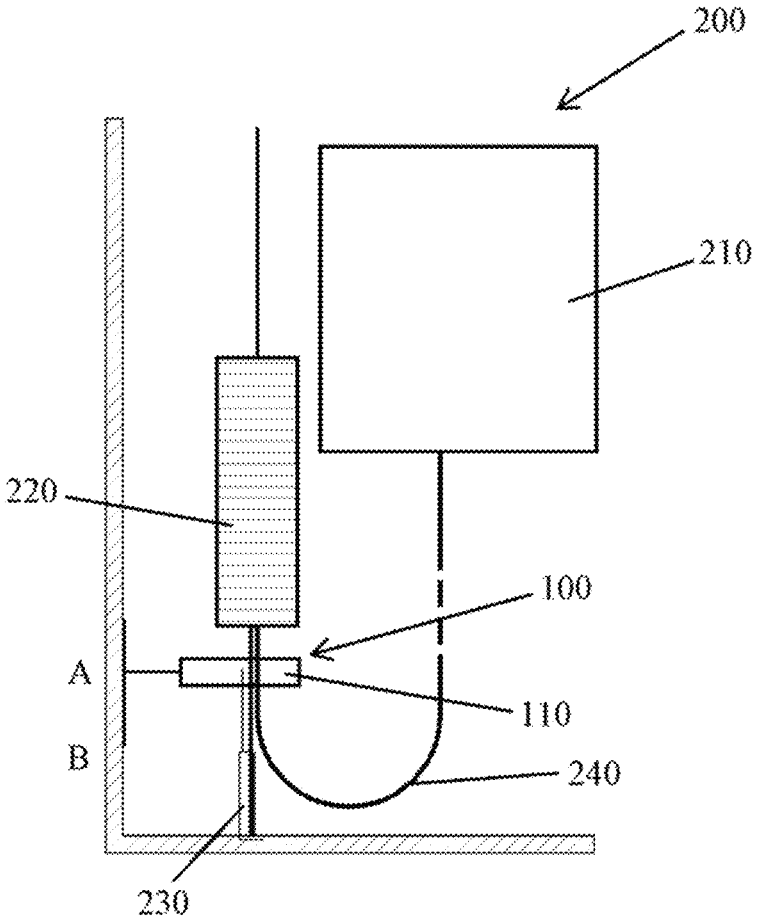
FIG. 5 is a schematic view of an embodiment of an elevator system having a guide device.

The illustrated fixed mechanism 110 includes a limiting portion and a resistance buffering portion. The limiting portion functions to constrain a movement direction of the guide mechanism. Specifically, it may limit a direction of the movement of the guide mechanism 120 relative to the fixed mechanism 110 to a vertical direction. The resistance buffering portion is configured to provide a resistance in the direction of the movement of the guide mechanism 120 relative to the fixed mechanism 110, and the guide mechanism 120 moves relative to the fixed mechanism 110 only when the resultant force of the external forces applied to the guide mechanism 120 exceeds the resistance. As such, a relatively specific form of structural design of the fixed mechanism is provided, which supports the functions of position limiting and partial pressure bearing. More specifically, the limiting portion in the figure may be a limiting slot 111. As shown in FIG. 3, a slot width of the limiting slot 111 at an opening portion 111*a* is smaller than a slot width of an inner portion 111*b* of the slot. For example, the limiting slot 111 may have a stepped shape with a small opening and a larger inner portion. The cooperative guide mechanism 120 has a first end extending into the limiting slot 111, and the first end of the guide mechanism 120 is designed to have a contour matching with the limiting slot 111, for example, a convex shape as viewed from the cross section shown in FIG. 4. The convex guide mechanism 120 may be either in an integral arrangement not shown in the figure, or a split type arrangement as shown in the figure, thereby bringing about an effect of more convenient installation. Specifically, the illustrated guide mechanism 120 includes a wider guide plate 125 and a narrower guide strip 126. The guide plate 125 may be inserted from the end of the limiting slot 111 and match with the inner portion 111*b* of the limiting slot 111, and the guide strip 126 may be directly inserted into the opening portion 111*a* of the limiting slot 111. After the assembly is completed, the guide plate 125 and the guide strip 126 may be fastened by various fixing means such as screwing or bonding. Of course, in a case that the guide strip and the guide plate are integrated into an integral design, they can be inserted as a whole directly from the end of the limiting slot. Then, the guide frame through which the compensation chain passes is further connected by the guide strip 126 to achieve a complete guide mechanism.

Further, as an example in which the resistance buffering portion provides a multi-stage resistance adjusting action, a plurality of locking grooves 112 may be disposed inside the limiting groove 111 in the vertical direction; correspondingly, an installation hole 121 is disposed at the first end of the guide mechanism 120, and an elastic member 122 and at least one ball 123 are inserted into the installation hole 121. In a state where no external force is exerted to the elastic member 122, the elastic member 122 presses the at least one ball 123 to protrude from the installation hole 121 and embed into at least one of the plurality of locking grooves 112. In a case that the elastic member 122 is subjected to for example a pressure applied by the counterweight from top to bottom, if a pressure residual still exists after the buffering of the buffer, then when the resultant force is greater than a vertical component by which the elastic member 122 presses the ball 123 into the locking groove 112, the ball 123 will laterally press the elastic member 122 into the installation hole 121, thereby achieving downward movement thereof. When the elastic member 122 moves downward to the next locking groove 112, it is either possible to reach a new balance of force, or the elastic member 122 may continue to move downward under the resultant force of the external forces to achieve buffering and avoid damage. Although only the cooperation of one ball with one locking groove is applied in the illustrated embodiment, it should also be appreciated that such a locking structure is designed to provide relative locking between the fixed mechanism and the guide mechanism. Therefore, in order to achieve this, a simultaneous cooperation of a plurality of balls and a plurality of locking grooves can be designed according to the actual force condition, thereby obtaining a larger resistance adjustment range. In addition, although only one structural form of the fixed mechanism which provides multi-stage resistance adjustment and the guide mechanism is described with reference to the drawings, those skilled in the art may also envisage other structural forms under the teachings of the structure and principle of the foregoing embodiments. For example, the resistance buffering portion may also be provided as one of a ratchet wheel or ratchet teeth, and the guide mechanism may be arranged to include the other of the ratchet teeth or ratchet wheel. Of course, under the above teachings, other structural forms that are not illustrated are also within the scope of protection of the present application. In addition, the resistance buffering portion may also be arranged to provide continuous resistance adjustment for the guide mechanism 120, and the principles of other multi-stage resistance adjustment are similar, which will not be further elaborated herein.

The above is a detailed description of a part of the specific structural form and connection relationship of connecting sides of the guide mechanism and the fixed mechanism, and a part of the specific structural form of a side of the guide mechanism which sways with respect to the compensation chain will be described as follows.

In an example, the guide mechanism 120 may include a guide frame 124, wherein in an installed state, the compensation chain of the elevator system 200 is arranged to pass through the guide frame 124, and the swaying space of the compensation chain is restricted by the guide frame 124. That is, when the compensation chain sways and collides with the guide frame 124, the possibility of further swaying outward is obviated. On this basis, in order to make the collision between the compensation chain and the guide frame softer, a buffering and limiting frame 124*a* having rollers 124*b* may be built in the guide frame 124. In this arrangement, when the buffering and limiting frame 124*a* collides with the swaying compensation chain, the buffering and limiting frame 124*a* can sway therewith inside the guide frame 124 by a certain distance, so that the collision of the compensation chain can be further buffered and finally constrained. Of course, the buffering and limiting frame 124*a* does not necessarily have to include the rollers 124*b*, and a relative movement thereof within the guide frame may also be realized by other structural forms, such as a slide rail or the like.

An embodiment of an elevator system 200 of the present application is further described herein in connection with FIGS. 5-8. The elevator system 200 includes a car 210, a counterweight 220, a buffer 230, a compensation chain 240, and a guide device 100 configured to guide the compensation chain of the elevator system; wherein two ends of the compensation chain 240 are connected to the car 210 and the counterweight 220 respectively, and the compensation chain 240 is arranged to pass through the guide mechanism 120 of the guide device 100; and wherein the fixed mechanism 110 of the guide device 100 is installed at a lower part of the elevator hoistway, and the buffer 230 is connected to the guide device 100 below the guide device 100, whereby an installation and arrangement of relevant parts of the elevator system is completed. Under such an arrangement of the elevator system, not only the demand of guiding the compensation chain in a normal state can be met, but also in a case of sudden abnormal condition, through the design of the fixed mechanism and the guide mechanism capable of moving relative to each other, the guide mechanism can move downward under the impact of the counterweight, so that the guidance to the compensation chain is continued, and damage of the compensation chain itself or entanglement of the compensation chain with other parts and pulling other parts apart are avoided.

In order to both guide the compensation chain and avoid damage by the impact from the counterweight in a better way, a start point A of the movement of the guide mechanism 120 of the guide device 100 may be set to correspond to the tangent point of the compensation chain 240 in an installed state or a position above the tangent point, and at the most, the start point may correspond to a highest plane of the buffer in an uncompressed state. Of course, in some cases, the start point may be lower than the highest plane of the buffer in the uncompressed state, which can be determined by a curvature tangent point of the compensation chain. In this case, under the normal operating conditions of the elevator, the guide mechanism can achieve the best guiding effect on the compensation chain, avoiding excessive swaying and entangling with or pulling other parts apart. At the same time, an end point B of the movement of the guide mechanism 120 of the guide device 100 may also be set to correspond to the limit buffering position of the buffer 230. In this case, in an abnormal operating state of the elevator, as long as the abnormality is still in a range in which the buffer can be adjusted, the guide mechanism can be effectively prevented from being damaged. As an alternative, setting a moving distance of the guide mechanism 120 of the guide device 100 in the foregoing embodiment to be greater than or equal to the compression stroke of the buffer would be enough.

Figure 7:
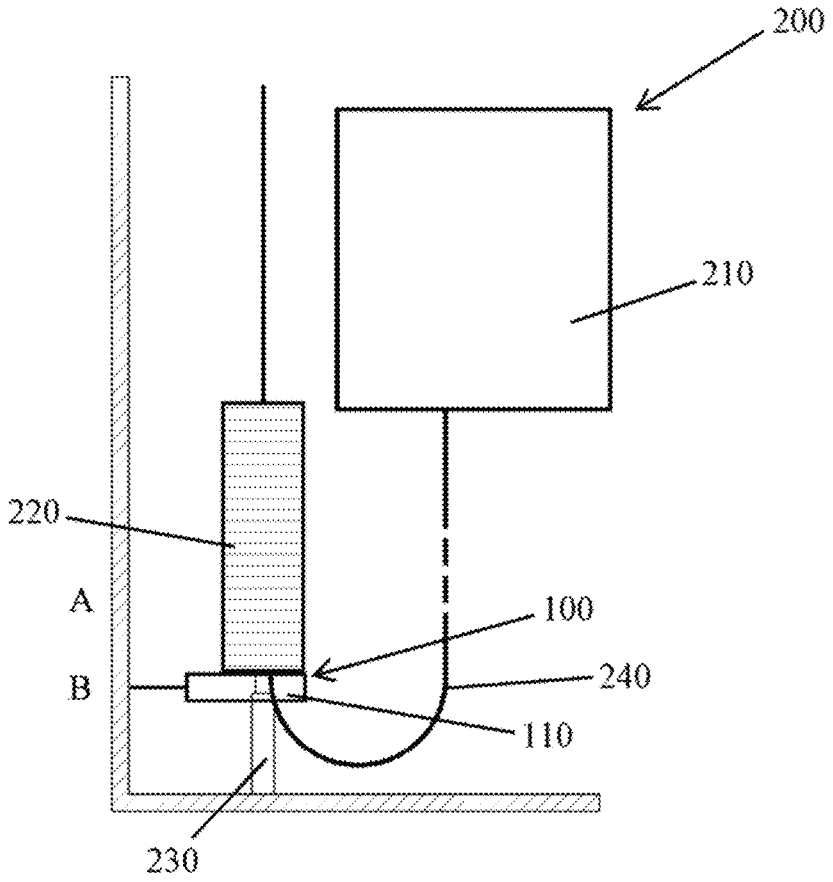
FIG. 7 is a schematic view of an operational process of an embodiment of an elevator system having a guide device in an abnormal state, wherein a counterweight goes down to push the guide device and a buffer to the lowest position.
Figure 8:
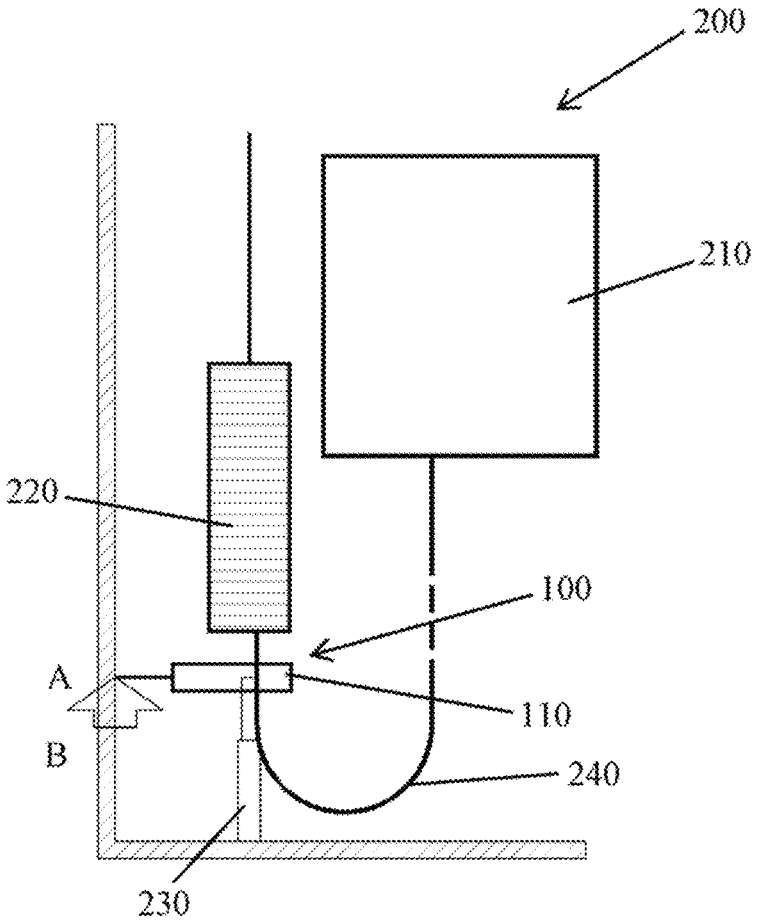
FIG. 8 is a schematic view of an operational process of an embodiment of an elevator system having a guide device in an abnormal state, wherein the device is debugged normally, the counterweight is restored to the normal position, and the guide device is manually or automatically adjusted to the start point of movement corresponding to the initial state.

The adjustment process of the elevator system having the guide device according to any of the foregoing embodiments or combinations thereof under abnormal conditions will be described below with reference to FIGS. 6 to 8.

Figure 6:
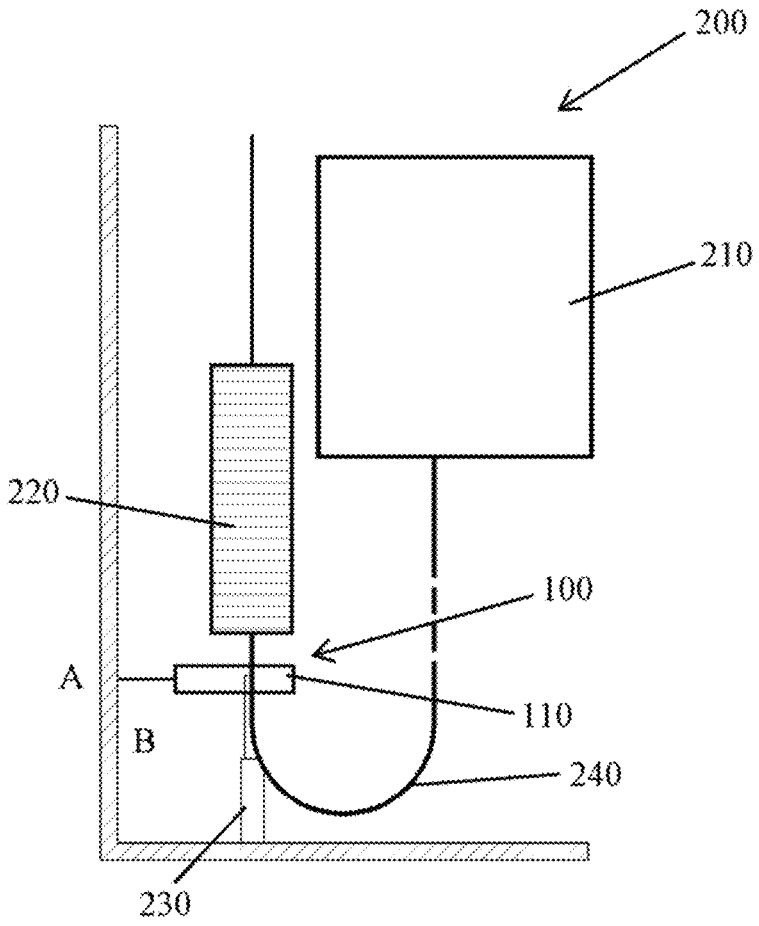
FIG. 6 is a schematic view of an operational process of an embodiment of an elevator system having a guide device in an abnormal state, wherein a counterweight goes down and begins to contact the guide device and impact a buffer.

First, referring to FIG. 6, in this case, it can be considered that the elevator system 200 is still under normal operating conditions, the counterweight 220 has not yet fallen to such an extent to contact the guide device 100, the guide device is at the tangent point of the compensation chain 240, and the buffer 230 has not yet started working. When the counterweight 220 continues to fall down to press against the guide device 100 and the buffer 230, if the resultant force of the two is still greater than the resistance provided in the vertical direction between the fixed mechanism and the guide mechanism in the guide device 100, the guide mechanism starts to move downward with respect to the fixed mechanism until a balance of the resultant force of the three can be achieved within the limit buffering stroke of the buffer, that is, the adjustment under this abnormal condition is completed. Referring subsequently to FIG. 8, the restoration of the guide device is achieved manually or automatically within a suitable time after the adjustment is completed, so that the guide device is returned to a normal operational position; that is, the guide device is again located at the tangent point of the compensation chain of the elevator system that is under normal operating condition, thereby providing the best anti-swaying guidance.

The guide device and the elevator system according to the present application are mainly described in the above examples. While only some of the embodiments of the present application have been described, those skilled in the art will understand that the present application can be carried out in many other forms without departing from the spirit and scope thereof. Therefore, the illustrated examples and embodiments should be considered as illustrative rather than limiting, and the present application can cover various modifications and replacements without departing from the spirit and scope of the present application defined by individual appended claims.

What is claimed is:

1. A guide device, which is configured to guide a compensation chain of an elevator system, characterized in that the guide device comprising:

a fixed mechanism, which is configured to install to an elevator hoistway and provide support for the guide device; and a guide mechanism connected to the fixed mechanism; wherein in a state where the guide mechanism is subjected to an external force exceeding a preset value, the guide mechanism is capable of reciprocating in a vertical direction relative to the fixed mechanism;

wherein the fixed mechanism comprises: a limiting portion which limits a direction of the movement of the guide mechanism relative to the fixed mechanism to a vertical direction; and a resistance buffering portion which provides a resistance in the direction of the movement of the guide mechanism relative to the fixed mechanism, wherein in a case that an external force exerted to the guide mechanism exceeds the resistance, the guide mechanism moves relative to the fixed mechanism;

wherein the limiting portion is a limiting slot, a slot width of the limiting slot at an opening being smaller than a slot width of an inner portion of the slot; and the guide mechanism has a first end extending into the limiting slot and having a contour matching with the limiting slot.

2. The guide device according to claim 1, wherein the resistance buffering portion is a plurality of locking grooves disposed inside the limiting slot in a vertical direction; and the first end of the guide mechanism has an installation hole in which an elastic member and at least one ball are disposed, wherein in a state where no external force is exerted to the elastic member, the elastic member presses the at least one ball to protrude from the installation hole and embed into at least one of the plurality of locking grooves.

3. The guide device according to claim 2, wherein the resistance buffering portion provides multi-stage resistance adjustment for the guide mechanism.

4. The guide device according to claim 1, wherein the guide mechanism comprises a guide frame, wherein in an installed state, the compensation chain of the elevator system is arranged to pass through the guide frame, and a swaying space of the compensation chain is restricted by the guide frame.

5. The guide device according to claim 4, wherein the guide frame has a built-in buffering and limiting frame, wherein in a case of colliding with the swaying compensation chain, the buffering and limiting frame is capable of swaying inside the guide frame to provide buffering and limiting for the compensation chain.

6. An elevator system, characterized in that comprising a car, a counterweight, a buffer, a compensation chain, and the guide device according to claim 1;

wherein two ends of the compensation chain are connected to the car and the counterweight respectively, and the compensation chain is arranged to pass through the guide mechanism of the guide device; and wherein the fixed mechanism of the guide device is installed at a lower part of the elevator hoistway, and the buffer is connected to the guide device below the guide device.

7. The elevator system according to claim 6, wherein a start point of the movement of the guide mechanism of the guide device corresponds to a tangent point of the compensation chain and the guide mechanism in the installed state or a position above the tangent point.

8. The elevator system according to claim 6, wherein a start point of the movement of the guide mechanism of the guide device corresponds to a highest plane of the buffer in an uncompressed state.

9. The elevator system according to claim 6, wherein a movement distance of the guide mechanism of the guide device is greater than or equal to a compression stroke of the buffer.

10. A guide device, which is configured to guide a compensation chain of an elevator system, characterized in that the guide device comprising:

a fixed mechanism, which is configured to install to an elevator hoistway and provide support for the guide device; and a guide mechanism connected to the fixed mechanism; wherein in a state where the guide mechanism is subjected to an external force exceeding a preset value, the guide mechanism is capable of reciprocating in a vertical direction relative to the fixed mechanism;

wherein the fixed mechanism comprises: a limiting portion which limits a direction of the movement of the guide mechanism relative to the fixed mechanism to a vertical direction; and a resistance buffering portion which provides a resistance in the direction of the movement of the guide mechanism relative to the fixed mechanism, wherein in a case that an external force exerted to the guide mechanism exceeds the resistance, the guide mechanism moves relative to the fixed mechanism;

wherein the resistance buffering portion is one of a ratchet wheel or ratchet teeth, and the guide mechanism comprises the other of the ratchet teeth or ratchet wheel.

* * * * *